US006350971B1

(12) United States Patent
Smolenski et al.

(10) Patent No.: US 6,350,971 B1
(45) Date of Patent: Feb. 26, 2002

(54) APPARATUS AND METHOD FOR DETECTING VESSEL MOVEMENT ON A COOKTOP SURFACE

(75) Inventors: Joseph Lucian Smolenski, Slingerlands; Allan John Connolly, Albany; Austars Raymond Schnore, Jr., Scotia; Aditya Kumar, Niskayuna; Walter Whipple, III, Amsterdam, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/729,125

(22) Filed: Dec. 4, 2000

(51) Int. Cl.[7] ..... H05B 1/02; H05B 3/68
(52) U.S. Cl. ..... 219/518; 219/447.1
(58) Field of Search ..... 219/490, 509, 219/518, 447.1, 445.1, 446.1, 448.11; 324/228, 234

(56) References Cited

U.S. PATENT DOCUMENTS 4,334,135 A * 6/1982 Smith ..... 219/518
5,296,684 A * 3/1994 Essig et al. ..... 219/518
5,424,512 A * 6/1995 Turetta et al. ..... 219/447.1
5,491,423 A * 2/1996 Turetta ..... 219/447.1
5,893,996 A 4/1999 Gross et al.
5,900,174 A * 5/1999 Scott ..... 219/447.1
5,977,523 A * 11/1999 Scott ..... 219/447.1

* cited by examiner

*Primary Examiner*—Sang Paik
(74) *Attorney, Agent, or Firm*—John F. Thompson; Jill M. Breedlove

(57) ABSTRACT

An apparatus is provided for detecting movement of a vessel positioned on a cooktop surface. The apparatus includes a resonant circuit that has at least an inductive loop positioned proximate to the cooktop surface. A signal conditioner is connected to the resonant circuit for conditioning signals received from the resonant circuit. A processor is connected to the signal conditioner and compares the conditioned signals received from the signal conditioner to a reference signal whereby detecting movement of the vessel.

31 Claims, 4 Drawing Sheets

APPARATUS AND METHOD FOR DETECTING VESSEL MOVEMENT ON A COOKTOP SURFACE

BACKGROUND OF THE INVENTION

The present invention relates to an apparatus and method for detecting movement of a vessel on a cooktop surface and more particularly to the detection of movement by measuring signals produced by an inductive loop positioned below the cooktop surface.

A popular trend in electronically controlled cooktops and/or ranges, typically, includes a cooktop surface composed of a glass-ceramic material that is positioned above one or more radiant heating elements. The cooktop includes various user controls that can be used by an operator to adjust the amount of power supplied to the radiant heating elements and, therefore, the heat desired for cooking. The radiant heating elements can be powered by, for example, electricity, natural gas, propane or iso-butane. The radiant heating elements and the controls are connected to a controller that user controls the amount of energy supplied to the cooktop. The cooktop can also includes temperature sensors and/or other sensor that are connected to the controller to aid in controlling the energy supplied to the radiant heating element and ultimately the heat supplied to the cooktop. The temperature sensors and other sensors are also used in conjunction with the controller and/or other processors to detect certain detrimental conditions that can arise during operation of the cooktop.

For example, the temperature sensors in conjunction with the controller and/or other processors can detect a boil dry condition. Typically, a boil dry condition occurs when the liquid contents of a vessel positioned on the cooktop is caused to boil by heat from the radiant heating source such that all the liquid contents are boiled from the vessel. Specifically, a boil drying condition is predicted when a relatively rapid increase in the temperature of the cooktop surface occurs while constant energy is being supplied to the radiant heating element. When all the liquid contents have been evaporated and/or converted to gas from the vessel being heated on the cooktop, the radiant heating source will continue to supply heat to the cooktop causing the cooktop surface and/or the vessel to overheat and possibly become damaged. To prevent such damage, the temperature sensors and/or other sensors provide information to the controller and/or other processors that predicts the boil dry condition based on specific sensor characteristics, and when a boil dry condition is detected, energy is no longer supplied to the radiant heating element.

In addition, the controller is programmed with a maximum temperature that should not be exceeded to ensure a long service life for the glass ceramic cooktop surface. When the temperature sensors and controller determine that the temperature of the cooktop and/or the vessel is approaching the maximum temperature, the controller instructs the radiant heating source to reduce the heat being applied to the cooktop such that a constant temperature is maintained. The controller also ensures that the constant temperature is at or below the maximum temperature. When the controller holds the radiant heating element at a constant temperature, the controller enters a condition known as thermal limiter mode. While in thermal limiter mode, the temperature of the cooking surface and/or the vessel cannot be used to determine if a boil dry condition has occurred because the cooktop and/or range is being held at a constant temperature. Therefore when the controller is in thermal limiter mode, a boil dry condition is determined by monitoring the energy being applied to the radiant heating source. During thermal limiter mode, a rapid decrease in energy applied to the radiant heating source to maintain the maximum temperature will be interpreted as a boil dry condition by the controller, and energy will no longer be applied to the radiant heating element.

When the controller is in thermal limiter mode, conditions may occur that make the controller predict a false boil dry condition. If the bottom of the vessel has areas that are warped, dirty or imperfect, the thermal characteristics of the vessel can change as the vessel is, for example, moved on the cooktop surface. These thermal characteristics can cause changes in the temperature sensed by the temperature sensor when the vessel is moved or rotated on the cooktop, when the vessel is heated or cooled, or when cold or hot contents are added to the vessel. For example, the temperature sensor may be located near an area where the bottom of the vessel has good thermal contact, and then the vessel is moved or rotated such that an area having poor thermal contact is located near the temperature sensor. Under these conditions, the temperature sensed by the temperature sensor may increase simply because the vessel has been moved or rotated. Due to the increase in temperature sensed by the temperature sensor, the controller may instruct that less energy should be applied to the radiant heating element to maintain the constant temperature. Thus, since less energy is being applied to the radiant heating source to maintain the temperature, the controller may detect a false boil dry condition during thermal limiter mode. However, under the condition where the change in temperature is caused by a warped vessel, a boil dry condition may not necessarily exist because the poor thermal characteristics of the vessel caused the change in temperature rather than an actual boil dry condition. The false boil dry condition can cause dissatisfaction to an operator of the cooktop because when a boil dry condition is detected the power to the radiant heating element is turned off. Therefore, a desire exists to eliminate or reduce false detection of boil dry conditions resulting from vessels having poor thermal qualities in an electronically controlled cooktop.

BRIEF SUMMARY OF THE INVENTION

In one exemplary embodiment, an apparatus is provided for detecting movement of a vessel positioned on a cooktop surface. The apparatus comprises a radiant heating element positioned below the cooktop surface for heating at least the vessel. A controller is provided and is connected to the radiant heating element. The controller controls power supplied to the radiant heating element. A temperature sensor is connected to the controller and measures the temperature near the cooktop surface. An inductive loop is positioned proximate to the cooktop surface. A detection circuit is connected to the controller and the inductive loop. The detection circuit detects movement of the vessel on the cooktop surface using signals produced by at least the inductive loop.

In even another exemplary embodiment, a method is provided for detecting movement of a vessel on a cooktop surface. The movement is detected using a resonant circuit including an inductive loop. The method comprising supplying an energy signal to the inductive loop. At least a resultant signal produced by the inductive loop is measured. At least a magnitude and phase of angle of the resultant signal are determined. An instantaneous inductance of the inductive loop is calculated from at least the magnitude and the phase angle of the resultant signal. A reference inductance is determined. The reference inductance is determined by tabulating a predetermined number of instantaneous inductances over a predetermined amount of time, and calculating the reference inductance from the tabulated instantaneous inductances. Movement of the vessel is detected by comparing the instantaneous inductance to the reference inductance.

DETAILED DESCRIPTION OF THE INVENTION

Figure 1:
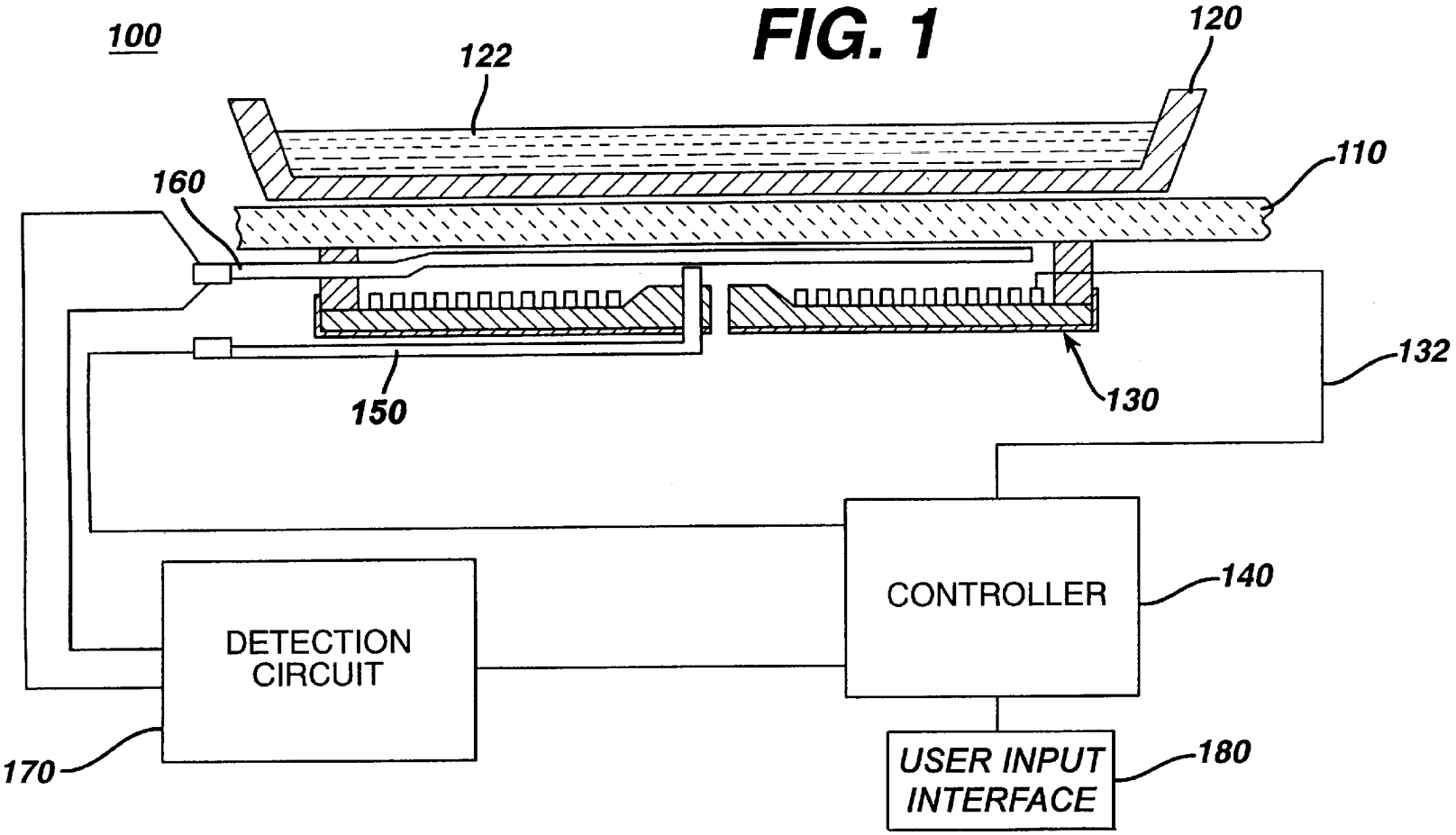
FIG. 1 is a cross-sectional view and block diagram of one exemplary embodiment of an electronically controlled cooktop.
Figure 2:
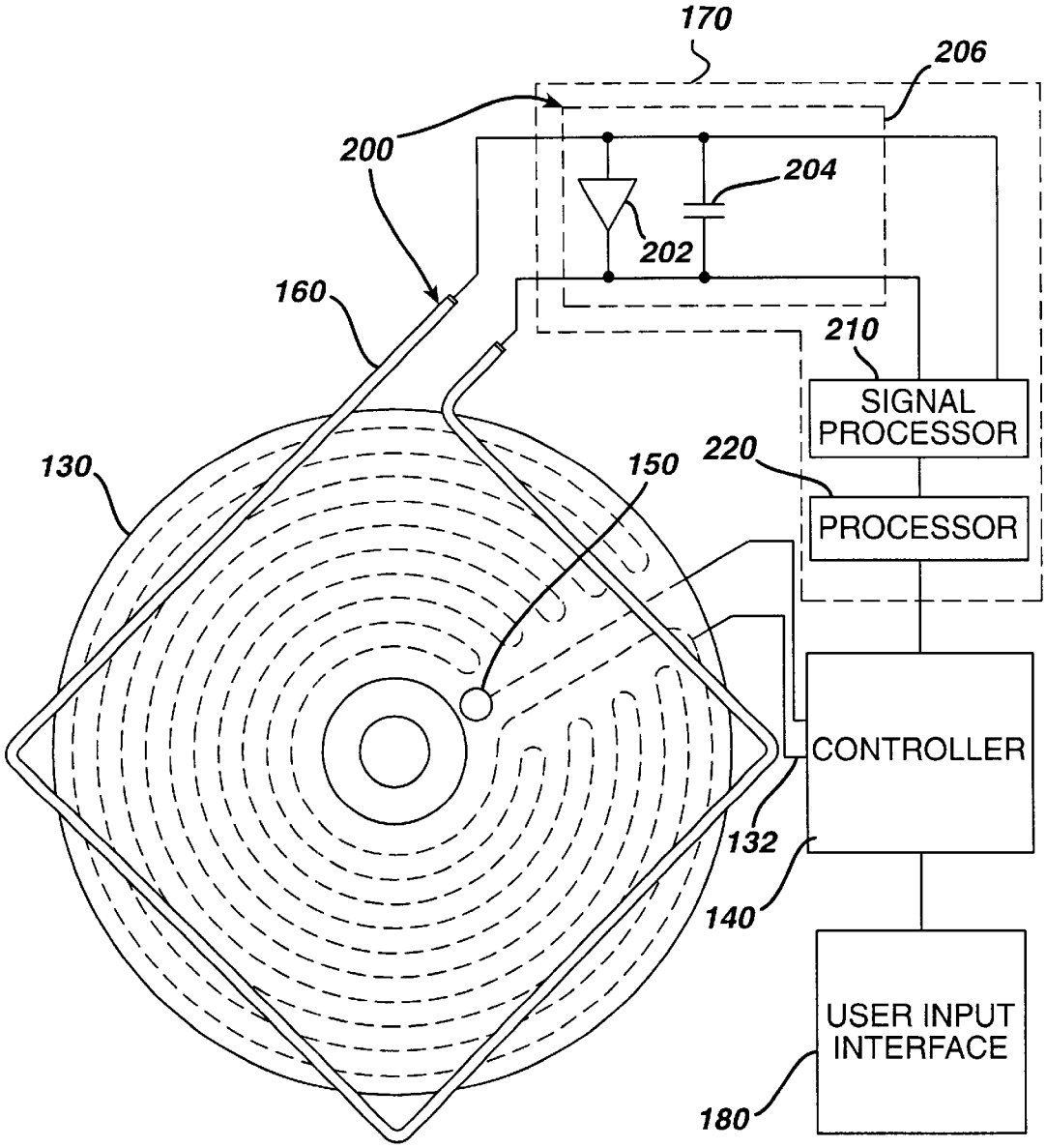
FIG. 2 is a top view and block diagram of another exemplary embodiment of an electronically controlled cooktop.

As shown in FIG. 1 and 2, one representative embodiment of an electronically controlled cooktop 100 is provided that comprises at least an inductive loop 160 and a detection circuit 170. When a vessel 120 is moved or rotated on a cooktop surface 110, the inductive loop 160 and the detection circuit 170 detects the movement of the vessel 120. The detection of the vessel 120 movement is communicated to a controller 140 such that, for example, a false determination of a boil dry condition, among other conditions, is reduced and/or eliminated.

As shown in FIG. 1, the electronically controlled cooktop 100 comprises a radiant heating element 130 positioned below a cooktop surface 110. It should be appreciated that, in other representative embodiments, that the radiant heating element 130 can be positioned on, above, proximate or within the cooktop surface 110. In addition, the radiant heating element 130 produces heat and can be powered by, for example, electrical energy, natural gas, propane, etc. It should also be appreciated that, in another representative embodiment, the cooktop surface 110 comprises a glass ceramic material. A vessel 120 contains contents 122 and is positioned on the cooktop surface 110. An inductive loop 160 is positioned below the cooktop surface 110 and is connected to a detection circuit 170. It should be appreciated that the induction loop 160 can, in other representative embodiments, comprise various shapes and sizes, such as, for example, a rectangular shape, a circular shape, a straight rod shape and a triangular shape. In addition, it should also be appreciated that the inductive loop 160 can be positioned, for example, on, near, within, above, and proximate to the cooktop surface 110 and/or proximate to the vessel 120. Additionally, it should also be appreciated that the mechanical design of the inductive loop 160 can also comprise other forms.

A temperature sensor 150 is positioned below the cooktop surface 110 to detect the temperature near the cooktop surface 110. In one embodiment, the temperature near the cooktop surface 110 comprises the temperature of the area between the heating element 130 and the cooktop surface 110. In another embodiment, the temperature near the cooktop surface 110 comprises the temperature of the cooktop surface 110. A controller 140 is connected to the radiant heating element 130 to supply a controlled energy output via output 132. Additionally, the controller 140 is connected to the temperature sensor 150 and the detection circuit 170. It should be appreciated that, in other representative embodiments, the detection circuit 170 can be comprised within the controller 140, and therefore, the inductive loop 160 can, in these other representative embodiments, be connected to the controller 140. A user input interface 180 is also connected to the controller 140 to allow a user to select a desired power level to heat the cooktop surface 110 and thus the contents 122 of the vessel 120.

As shown in FIG. 2, one representative embodiment of the detection circuit 170 includes a capacitive circuit 206 having a capacitor 204 connected in parallel to an amplifier 202. The capacitive circuit 206 is connected to the inductive loop 160. The combination of the capacitive circuit 206 and the inductive loop 160 comprises an electronic oscillator 200. Also shown in FIG. 2, the detection circuit 170 also comprises a signal processor 210 connected to the capacitive circuit 206 and a processor 220 connected to the signal processor 210 and the controller 140.

Figure 3:
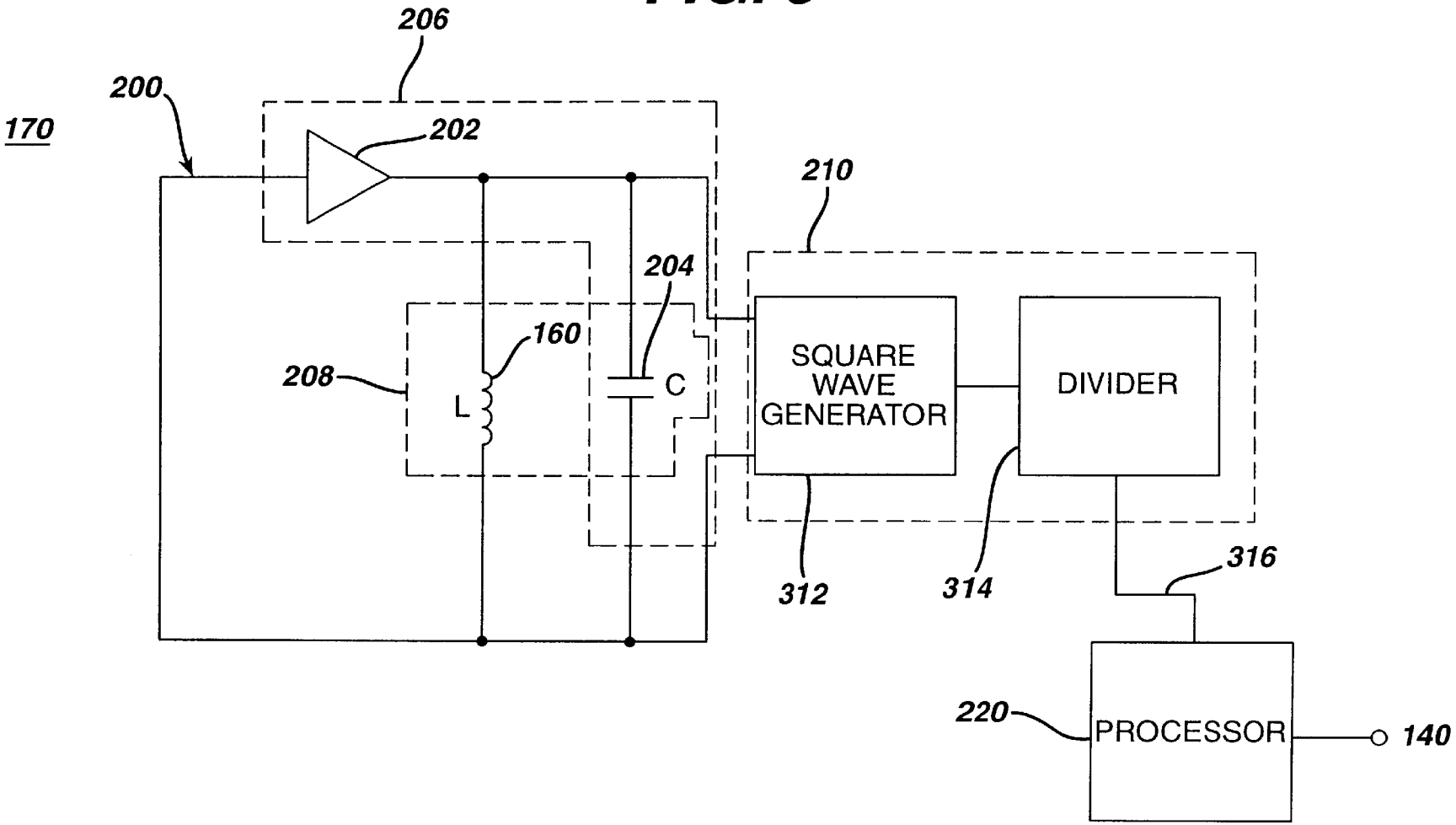
FIG. 3 is a block diagram of one exemplary embodiment of a detection circuit.

In FIG. 3, in another representative embodiment, the signal processor 210 of the detection circuit 170 further comprises a square wave generator 312 connected to the electronic oscillator 200 and a divider 314 connected to the processor 220 and the square wave generator 312. The processor 220 is connected to the divider 314 via output 316. In addition, the processor 220 is also connected to the controller 140. The combination of the capacitor 204 and the inductive loop 160 comprises resonant circuit 208. In the resonant circuit 208, the inductive (L) component comprises the inductive loop 160 and the capacitive (C) component comprises the capacitor 204. Therefore, the resonant circuit 200 comprises a tuned L-C circuit that can be tuned to detect a desired resonant frequency based on the choice of the inductive loop 160 (inductance L) and the capacitor 204 (capacitance C).

When the vessel 120 is moved or rotated on the cooktop surface 110, the effective inductance of the inductive loop 160 changes and therefore, the resonant frequency of the resonant circuit 208 also changes. As such, in one representative embodiment, an energy signal is supplied to the inductive loop 160. The movement of the vessel 120 can be determined by measuring the inductance of the inductive loop 160 over a predetermined amount of time and comparing the measured inductance to a reference inductance. The absolute value of the difference between the measured inductance and the reference inductance determines if the vessel 120 has been moved or rotated if the difference is greater than a predetermined value. In one representative embodiment, the predetermined value comprises a value that is, for example, about zero. In another representative embodiment, the predetermined value comprises a value that is, for example, greater than about zero. It should be appreciated that the energy signal supplied to the inductive loop 160 can comprise, for example, a fixed excitation energy signal or a variable excitation energy signal.

In even another representative embodiment, an energy signal is supplied to the inductive loop 160. The movement of the vessel 120 is determined by measuring the frequency of the resonant circuit 208 over a predetermined amount of time and comparing the measured frequency to a reference frequency. In one representative embodiment, the absolute value of the difference between the measured frequency and the reference frequency determines if the vessel 120 has been moved or rotated when the difference is greater than a predetermined value. In one representative embodiment, the predetermined value comprises a value that is, for example, about zero. In another representative embodiment, the predetermined value comprises a value that is, for example, greater than about zero. It should be appreciated that the energy signal supplied to the inductive loop 160 can comprise, for example, a fixed excitation energy signal or a variable excitation energy signal.

In yet another representative embodiment, an energy signal is supplied to the inductive loop 160. The magnitude and the phase angle of a resultant signal from the inductive loop 160 are measured. In one embodiment the resultant signal from the inductive loop 160 comprises, for example, the voltage and/or current of the inductive loop 160. The instantaneous inductance of the inductive loop 160 is calculated from at least the magnitude and the phase angle. The instantaneous inductance of the inductive loop 160 is compared to a reference inductance to determine movement of the vessel 120. In one embodiment, the absolute value of the difference between the instantaneous inductance and the reference inductance determines if the vessel 120 has been moved or rotated when the difference is greater than a predetermined value. In one representative embodiment, the predetermined value comprises a value that is, for example, about zero. In another representative embodiment, the predetermined value comprises a value that is, for example, greater than about zero. It should be appreciated that the energy signal supplied to the inductive loop 160 can comprise, for example, a fixed excitation energy signal or a variable excitation energy signal.

In one embodiment, a reference inductance is determined by tabulating a predetermined number of instantaneous inductances of the inductance loop 160 over a predetermined amount of time. The tabulated instantaneous inductances are used to calculate the reference inductance, such as, for example, taking an average of the predetermined number of tabulated instantaneous inductances over the predetermined amount of time. It should be appreciated that other methods of determining a reference inductance can be used, such as, for example, calculating a reference inductance before each use.

Figure 4:
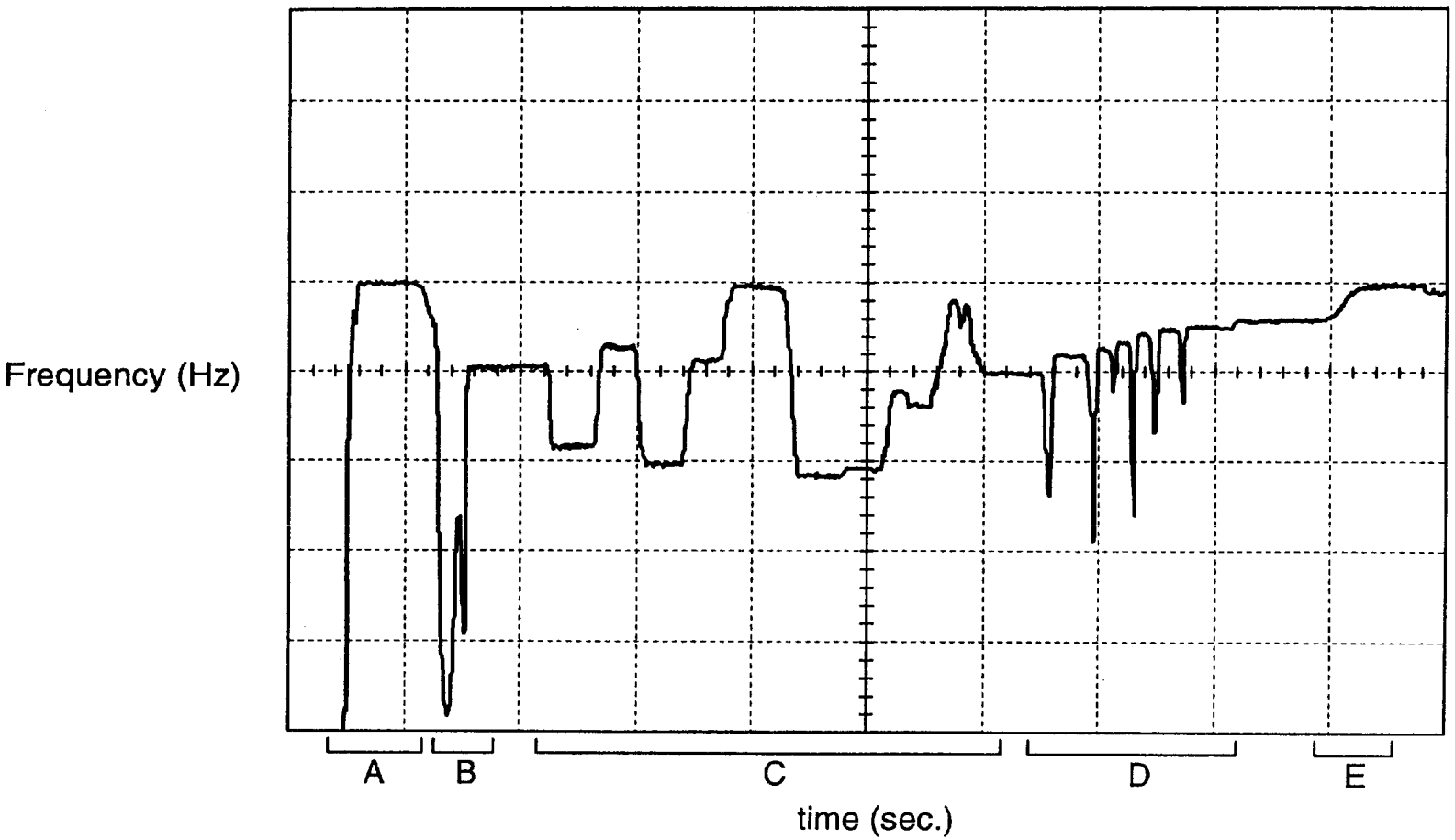
FIG. 4 a graphic representation of various signals measured by an exemplary embodiment of the detection circuit.

As shown in FIG. 3, the square wave generator 312 receives signals from the electronic oscillator 200. As described above, the signals can comprise, for example, frequency, magnitude, phase angle, voltage and current. The square wave generator 312 generates a square wave in response to the signals received from the electronic oscillator 312. The square wave from the square wave generator 312 is supplied to the divider 314 output 316. The divider 314 divides the square wave signal into a predetermined number of pulses per second to allow easier calculation by the processor 220. It should be appreciated that the divider 314 is used to assist the processor 220 during calculation of the frequency. In another embodiment, the divider 314 is not required and the processor 220 can be connected directly to the square wave generator 312. In even another embodiment, the divider 314 and the square wave generator 312 are not required and the processor 220 can be directly connected to the electronic oscillator 200. The divided square wave signal from the divider 314 is measured and recorded by the processor 220. In one representative embodiment, the processor 220 is used to count the pulses produced by the divider 314 in response over a predetermined amount of time and measures the frequency or other properties of the square wave signal. Typically, a stable signal (frequency, inductance, current or voltage) is generated when the vessel 120 is stationary, as shown in FIG. 4 at time period A. Also shown in FIG. 4, the signal will include variations when the vessel 120 is moved or rotated, such as, for example, rotation of the vessel (time periods B and E), rocking the vessel 120 (time period D) and small discreet movements (time period C).

Any movement of the vessel 120 that changes the amount of metal and/or the gap length between the vessel 120 and the field of the inductive loop 160 will have the effect of changing the inductance of the inductive loop 160. Accordingly, the frequency of the oscillations of the electronic oscillator 200 and/or the resonant circuit 208 will also change. Therefore, the processor 220 determines the movement of the vessel 120 by comparing the reference inductance and instantaneous inductance. In one representative embodiment, the reference signal comprises, for example, a value measured earlier in time and/or an average of prior tabulated instantaneous inductances. In another representative embodiment, when movement of the vessel 120 is detected, the processor 220 provides a signal and/or data to the controller 140 and the controller 140 executes a predetermined function in response to the received signal. It should be appreciated that, in other representative embodiments, the second processor 324 supplies the data from the divider 314 to the controller 140, and the controller 140 performs the analysis of the divided square wave signal.

When the controller 140 has determined that the vessel 120 has been moved, the controller 140 can reduce or eliminate the false detection of various conditions involved with using a radiant heating element 130 to heat the contents 122 of a vessel 120 positioned on a cooktop surface 110. In one representative embodiment, a boil dry condition that is detected immediately after movement or rotation of the vessel 120 can be ignored to eliminate a false boil dry detection. In addition, the determination of vessel 120 movement can also be used in temperature control, boil detection and other conditions to reject disturbances caused by movement of the vessel 120 and make the detection of these conditions more robust.

The foregoing discussion of the invention has been presented for purposes of illustration and description. Further, the description is not intended to limit the invention to the form disclosed herein. Consequently, variations and modifications commensurate with the above teachings and with the skill and knowledge of the relevant art are within the scope of the present invention. The embodiment described herein above is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. An apparatus for detecting movement of a vessel positioned on a cooktop surface, the apparatus comprising:

a radiant heating element positioned below the cooktop surface for heating at least the vessel;

a controller connected to the radiant heating element for controlling energy supplied to the radiant heating element;

at least one sensor connected to the controller wherein the at least one sensor providing information to the controller for determination of at least a sensed vessel heating condition;

an inductive loop positioned proximate to the cooktop surface; and a detection circuit connected to the controller and the inductive loop for detecting movement of the vessel on the cooktop surface using signals produced by at least the inductive loop, wherein the controller prevents the sensed vessel heating condition from being detected when the power to the radiant heating element increases after movement of the vessel has been detected by the detection circuit from the inductive loop.

2. The apparatus of claim 1 wherein the signals measured from the inductive loop comprise frequency signals.

3. The apparatus of claim 2 wherein the detection circuit measures the frequency signals over a predetermined time and movement of the vessel being determined by comparing the measured frequency signals to a reference frequency signal.

4. The apparatus of claim 1 wherein the signals measured from the inductive loop comprise voltage signals.

5. The apparatus of claim 4 wherein the detection circuit using the voltage signals to determine an inductance of the inductive loop and movement of the vessel being determined by comparing the inductance to a reference inductance.

6. The apparatus of claim 1 wherein the signals measured from the inductive loop comprise current signals.

7. The apparatus of claim 6 wherein the detection circuit using the current signals to determine an inductance of the inductive loop and movement of the vessel being determined by comparing the inductance to reference inductance.

8. The apparatus of claim 1 wherein the controller is connected to a user input interface allowing a user to input a desired power level.

9. The apparatus of claim 1 wherein the cooktop surface comprises a glass ceramic material.

10. An apparatus for detecting movement of a vessel positioned on a cooktop surface and approximately over a radiant heating element, the apparatus comprising:

a resonant circuit comprising at least an inductive loop connected to a capacitor, the inductive loop positioned proximate to the cooktop surface;

a signal conditioner connected to the resonant circuit for conditioning signals received from the resonant circuit; and a processor connected to the signal conditioner, the processor comparing the conditioned signals received from the signal conditioner to a reference signal whereby detecting movement of the vessel, a controller connected to the processor for supplying power to the radiant heating element based upon at least information received from the processor;

at least one sensor connected to the controller for providing sensed information to the controller for determination of at least one sensed vessel heating condition wherein the controller prevents the sensed vessel heating condition from being detected when a power to the radiant heating element increases after movement of the vessel has been detected by the processor from the inductive loop.

11. The apparatus of claim 10 further comprising:

a radiant heating element positioned below the cooktop surface for heating at least the vessel;

a controller connected to the radiant heating element for controlling power supplied to the radiant heating element;

a temperature sensor connected to the controller for measuring a temperature near the cooktop surface; and a user input interface connected to the controller allowing a user to input a desired power level.

12. The apparatus of claim 10 wherein the resonant circuit comprises the capacitor connected in parallel with the inductive loop.

13. The apparatus of claim 12 further comprising an electronic oscillator comprising the resonant circuit connected to an amplifier.

14. The apparatus of claim 12 wherein the signals received from the resonant circuit comprise frequency signals.

15. The apparatus of claim 12 wherein the signal conditioner measures the frequency signals over a predetermined time.

16. The apparatus of claim 10 wherein the signals received from the resonant circuit comprise voltage signals.

17. The apparatus of claim 16 wherein the signal conditioner uses the voltage signals to determine an inductance of the inductive loop.

18. The apparatus of claim 10 wherein the signals measured from the resonant circuit comprise current signals.

19. The apparatus of claim 18 wherein the detection circuit uses the current signals to determine an inductance of the inductive loop.

20. The apparatus of claim 10 wherein the cooktop surface comprises a glass ceramic material.

21. A method for detecting movement of a vessel on a cooktop surface using a resonant circuit including an inductive loop, the vessel positioned approximately above a radiant heating element, the method comprising the steps of:

supplying an energy signal to the inductive loop;

measuring at least a resultant signal produced by the inductive loop;

determining at least a magnitude and phase of angle of the resultant signal;

calculating an instantaneous inductance of the inductive loop from at least the magnitude and the phase angle of the resultant signal;

determining a reference inductance;

detecting movement of the vessel by comparing the instantaneous inductance to the reference inductance; and preventing a sensed vessel heating condition from being detected when power supplied to the radiant heating element increases after movement of the vessel has been detected from the inductive loop by the step of detecting movement.

22. The method of claim 21 wherein the step of determining a reference signal comprises:

tabulating a predetermined number of instantaneous inductances of the inductive loop over a predetermined time; and calculating the reference inductance based on the step of tabulating.

23. The method of claim 21 wherein the resonant circuit further comprises a capacitor connected in parallel to the inductive loop.

24. The method of claim 22 further comprising an electronic oscillator comprising the resonant circuit connected to an amplifier.

25. A method for detecting movement of a vessel on a cooktop surface using an inductive loop positioned proximate to the cooktop surface, the vessel positioned approximately above a radiant heating element, the method comprising the steps of:

supplying an energy signal to the inductive loop;

measuring a resultant signal from the inductive loop;

calculating an instantaneous inductance of the inductive loop from at least the resultant signal received from the inductive loop;

tabulating a predetermined number of instantaneous inductances of the inductive loop over a predetermined time;

calculating a reference inductance based on the step of tabulating;

comparing the instantaneous inductance of the inductive loop to the reference inductance;

detecting movement of the vessel based on the step of comparing; and preventing a sensed vessel heating condition from being detected when power supplied to the radiant heating element increases after movement of the vessel has been detected from the inductive loop by the step of detecting movement.

26. The method of claim 25 wherein the step of detecting movement comprises detecting movement when an absolute value of a difference between the instantaneous inductance and the reference inductance is greater than a predetermined value.

27. The method of claim 25 wherein the resultant signal received from the inductive loop comprises a voltage signal.

28. The method of claim 25 wherein the resultant signal received from the inductive loop comprises a current signal.

29. The method of claim 25 wherein the step of supplying an energy signal supplies a fixed excitation energy signal.

30. The method of claim 25 wherein the step of supplying an energy signal supplies a fixed excitation energy signal.

31. The method of claim 25 wherein the resultant signal received from the inductive loop comprises a frequency signal.

* * * * *